US010548386B2

(12) United States Patent
Chung

(10) Patent No.: US 10,548,386 B2
(45) Date of Patent: Feb. 4, 2020

(54) COSMETIC APPLIQUE REMOVAL FEATURE

(71) Applicant: Pui Yan Chung, San Diego, CA (US)

(72) Inventor: Pui Yan Chung, San Diego, CA (US)

( * ) Notice: Subject to any disclaimer, the term of this patent is extended or adjusted under 35 U.S.C. 154(b) by 16 days.

(21) Appl. No.: 15/847,861

(22) Filed: Dec. 19, 2017

(65) Prior Publication Data

US 2018/0168320 A1 Jun. 21, 2018

Related U.S. Application Data

(60) Provisional application No. 62/436,355, filed on Dec. 19, 2016.

(51) Int. Cl.
*A45D 40/26* (2006.01)
*A45D 34/04* (2006.01)

(52) U.S. Cl.
CPC ..... *A45D 40/267* (2013.01); *A45D 34/046* (2013.01)

(58) Field of Classification Search
CPC .. A45D 40/267; A45D 34/042; A45D 34/043; A45D 34/045; A45D 34/046; A45D 34/047; A45D 40/262; A45D 40/265; A45D 40/268
See application file for complete search history.

(56) References Cited

U.S. PATENT DOCUMENTS 2,644,183 A * 7/1953 Kellett ..... A45D 34/046 15/257.05
4,403,624 A * 9/1983 Montgomery ..... A45D 40/267 132/218
5,873,669 A * 2/1999 Poore ..... A45D 34/046 401/122
5,961,238 A * 10/1999 de Bruin ..... A45D 40/267 401/122
6,280,112 B1 * 8/2001 Vieu ..... A45D 34/042 401/122
7,967,519 B2 * 6/2011 Gueret ..... A45D 40/267 401/121
8,403,580 B2 * 3/2013 De Laforcade ..... A45D 40/267 401/122
8,721,210 B2 * 5/2014 Wilczynski ..... A45D 40/267 401/122

* cited by examiner

*Primary Examiner* — David J Walczak
(74) *Attorney, Agent, or Firm* — Genius Patent APC; Bruce Hare

(57) ABSTRACT

An insertable applique removal feature includes: a protruding lip; a cylindrical body coupled to the lip; and an applique removal element having multiple inwardly curving petals coupled to the body, each petal separated from each adjacent petal by a gap when said petals are in a relaxed state. A mascara tube includes: a cylindrical neck having a first radius; a cylindrical reservoir coupled the neck, the reservoir having a second radius, wherein the second radius is greater than the first radius; a first mascara removal feature including: a cylindrical body located along an interior surface of the neck; and a set of petals protruding from one end of the body and forming a convex shape that extends into a portion of the reservoir, where each petal is separated from each adjacent petal by a gap when the petals are in a relaxed state and has a substantially constant thickness.

20 Claims, 16 Drawing Sheets

COSMETIC APPLIQUE REMOVAL FEATURE

CROSS-REFERENCE TO RELATED APPLICATIONS

This application claims priority to U.S. Provisional Patent Application Ser. No. 62/436,355, filed on Dec. 19, 2016.

BACKGROUND

Makeup applicators are used for applying applique. Such applique may have various consistencies, viscosity, and/or other attributes. Users may want to apply the applique with an applicator that is loaded with a desired amount and consistency of applique. Current solutions may provide an applicator that does not allow for removal of excess applique.

Many types of makeup, for instance mascara, may require a particular consistency of applique on an applicator. Many current applicators may provide a consistency of applique that is thicker than desired, resulting in "clumping" that causes unsightly results after applying the applique material.

Thus there is a need for an applique removal feature that is able to conveniently and automatically remove excess applique without requiring any additional user effort or external tools.

SUMMARY

Some embodiments may provide a cosmetic applique removal feature. The removal feature may be associated with various types of cosmetics or "appliques" (e.g., solutions such as mascara, suspensions, ointments or pastes, powders, gels, solids, etc.).

Such a feature may be sized and shaped such that the feature is able to replace existing removal features (or add a removal feature if not included) in a typical applique vessel (e.g., a mascara tube). In some embodiments, the feature may be a stand-alone element that is inserted into a vessel. Alternatively, the feature may be embedded or otherwise included as part of a vessel itself.

The applique removal feature may be located at or near the neck of an applique vessel, such that applique is removed as an application element is withdrawn from the vessel.

The removal feature may include a cylindrical body able to fit many applique vessels. One of ordinary skill in the art will recognize that the so-called "cylindrical body" may have different shapes, as appropriate to match a particular vessel (e.g., rectangular, oval, triangular, hexagonal, etc.).

The applique removal feature may include multiple petals that form a convex bullet shape. The petals may be arranged symmetrically about a center axis of the cylindrical body. Different embodiments may include different numbers of petals (e.g., four, six, etc.). The thickness and/or flexibility of the petals may be varied across embodiments depending on a desired level of applique removal (e.g., a thinner, more flexible set of petals may remove less material than a thicker, more rigid set of petals).

The petals may be arranged such that an opening is formed at one end of the convex bullet shape. The opening may be sized such that an applicator wand is able to pass through the opening without engaging the petals. In some embodiments, the opening may be large enough that a portion of the applicator may pass through without engaging the petals.

Some embodiments may include secondary applique removal feature in addition to, or instead of, the primary petal-type feature. Such a secondary feature may be located along an interior surface of the cylindrical body. If there is a petal-type removal feature, the secondary feature would typically be located such that the secondary feature is engaged after the primary feature as an applicator is removed from the vessel.

In some embodiments, the secondary feature may include a flexible membrane with a through-hole at the center. The membrane may extend out from the inner wall of the cylindrical body. The through-hole may be sized such that an applicator wand is able to pass through the membrane. Some embodiments may include a larger through-hole that allows at least a portion of an applicator to pass through. Alternatively, in some embodiments, the secondary feature may include a set of protruding fingers arranged radially about a center of the cylindrical body.

The preceding Summary is intended to serve as a brief introduction to various features of some exemplary embodiments. Other embodiments may be implemented in other specific forms without departing from the scope of the disclosure.

BRIEF DESCRIPTION OF THE SEVERAL VIEWS OF THE DRAWINGS

The exemplary features of the disclosure are set forth in the appended claims. However, for purpose of explanation, several embodiments are illustrated in the following drawings.

DETAILED DESCRIPTION

The following detailed description describes currently contemplated modes of carrying out exemplary embodiments. The description is not to be taken in a limiting sense, but is made merely for the purpose of illustrating the general principles of some embodiments, as the scope of the disclosure is best defined by the appended claims.

Various features are described below that can each be used independently of one another or in combination with other features. Broadly, some embodiments generally provide an applique removal feature.

A first exemplary embodiment provides an insertable applique removal feature comprising: a protruding lip; a cylindrical body coupled to the protruding lip; and an applique removal element comprising a plurality of petals, each petal from the plurality of petals coupled to the cylindrical body.

A second exemplary embodiment provides a mascara tube comprising: a cylindrical neck having a first radius; a cylindrical reservoir coupled the cylindrical neck, the cylindrical reservoir having a second radius, wherein the second radius is greater than the first radius; a first mascara removal feature comprising: a cylindrical body located along an interior surface of the cylindrical neck; and a set of petals protruding from one end of the cylindrical body and forming a convex shape that extends into a portion of the cylindrical reservoir.

A third exemplary embodiment provides a mascara tube insert comprising: a lip able to engage an outer edge along a mouth of the mascara tube; a retention element able to engage an edge at a joint of a neck of the mascara tube and a reservoir of the mascara tube; and a first mascara removal feature.

Figure 1:
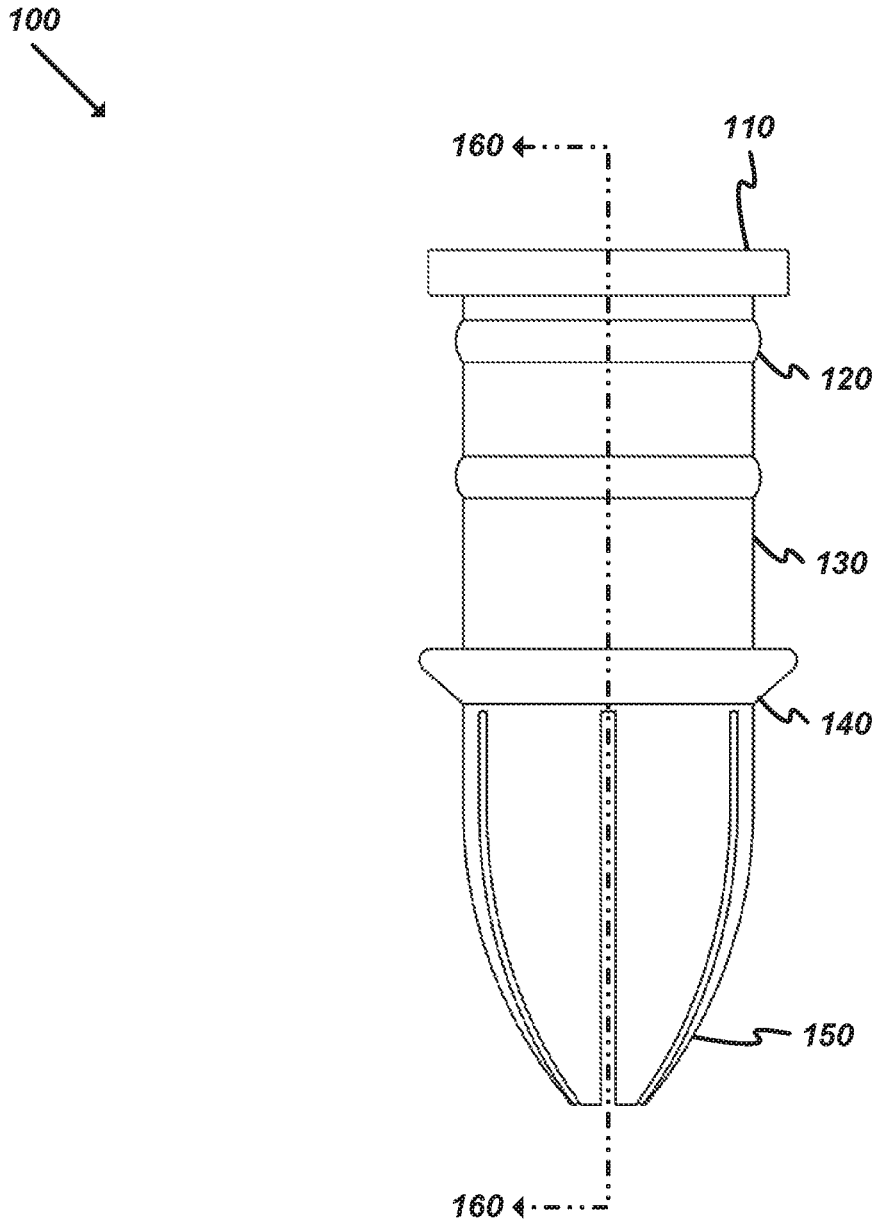
FIG. 1 illustrates a front elevation view of an applique removal feature according to an exemplary embodiment.
Figure 2:
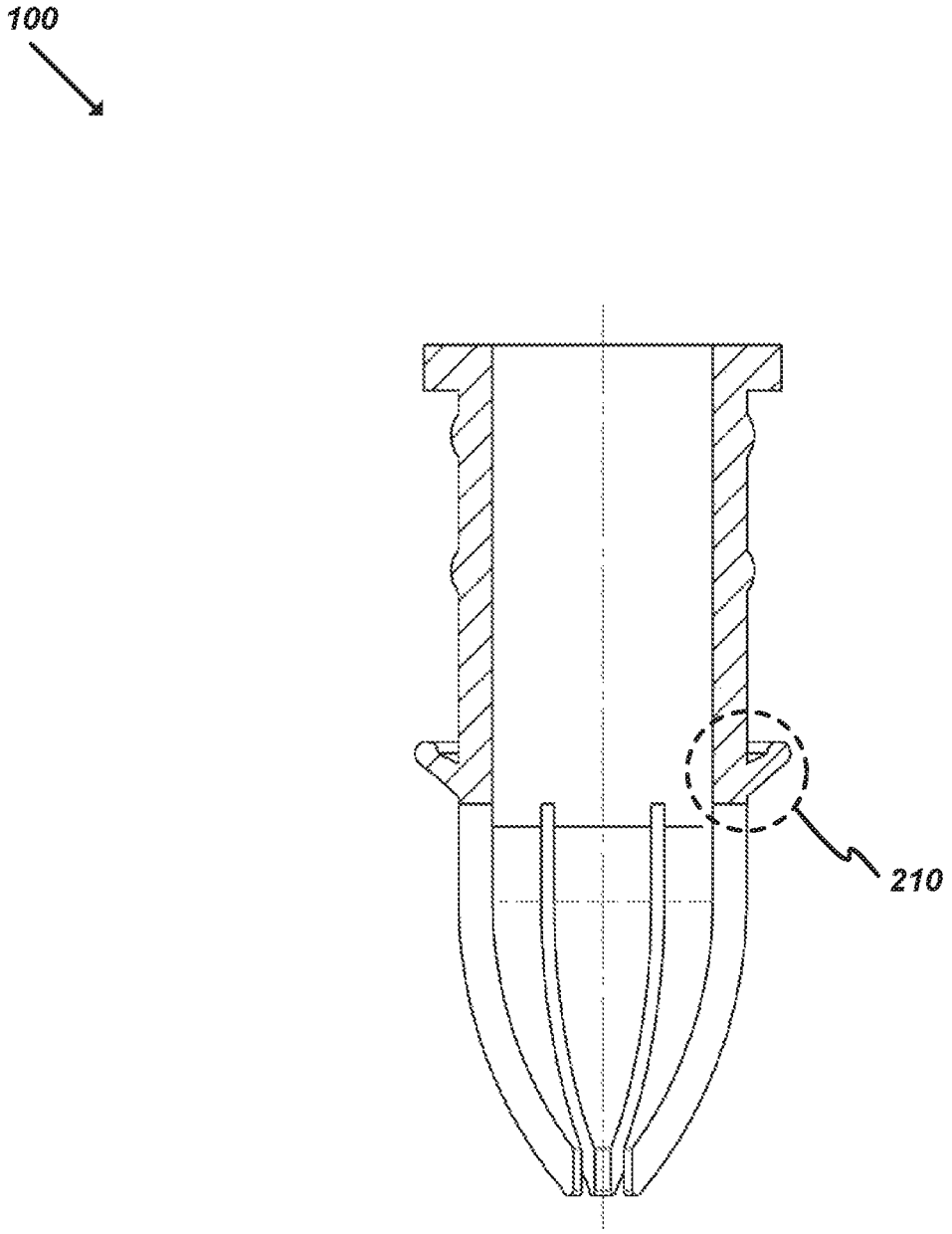
FIG. 2 illustrates a front section view of the applique removal feature of FIG. 1.
Figure 3:
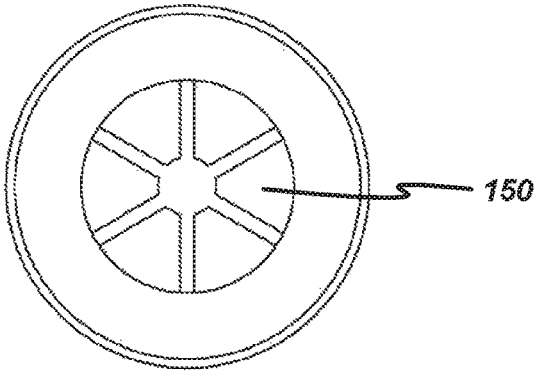
FIG. 3 illustrates a top plan view of the applique removal feature of FIG. 1.
Figure 4:
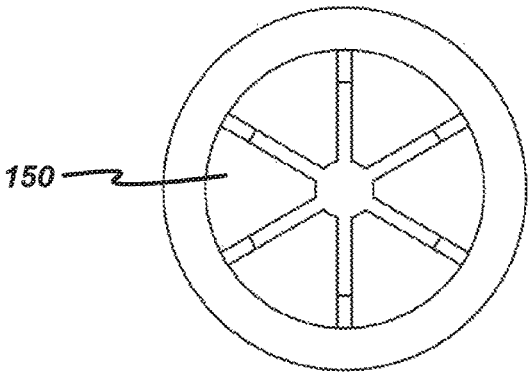
FIG. 4 illustrates a bottom plan view of the applique removal feature of FIG. 1.
Figure 5:
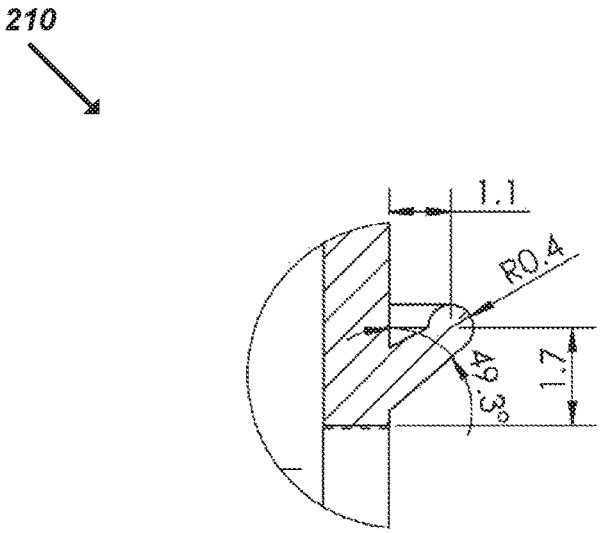
FIG. 5 illustrates a detailed front elevation view of a portion of the applique removal feature of FIG. 1.

FIG. 1 illustrates a front elevation view of an applique removal feature 100 according to an exemplary embodiment. FIG. 2 illustrates a front section view of the applique removal feature 100 along line 160. FIG. 3 illustrates a top plan view of the applique removal feature 100. FIG. 4 illustrates a bottom plan view of the applique removal feature 100. FIG. 5 illustrates a detailed front elevation view of a portion 210 of the applique removal feature 100.

Such a feature may be able to be inserted into the neck of a mascara bottle or other appropriate applique vessel. In some embodiments, a similar feature may be embedded or formed into the vessel itself rather than being a separate insert. As shown, the removal feature 100 may include a lip 110, various ridges 120, a body 130, a retaining element 140, and a set of applique removal petals 150.

The lip 110 may engage an outer edge of an applique vessel opening. For instance, the lip may retain one end of the feature 100 at the mouth of a mascara tube.

The ridges 120 may retain the feature 100 within a neck of the applique vessel. The ridges 120 may be located along an exterior surface or wall of the body 130.

The cylindrical body 130 may fit within the neck of the applique vessel. The retaining element 140 may extend out past the neck of the applique vessel to engage a portion of a reservoir of the vessel. The feature 100 is shown relative to a vessel in FIG. 26 below.

The applique removal petals 150 may together form an applique removal element. The petals 150 may be arranged symmetrically about a center axis of the feature 100. As shown, the petals 150 may extend out from the body 130 to form a convex curved shape with a flat end. In addition, an opening may be formed at one end of the convex shape, defined by the ends of the petals 150.

The petals 150 and body 130 may be made of different materials. For instance, the body may be made of a flexible rubber or silicon material while the petals 150 may be made of plastic.

As shown in FIG. 3 and FIG. 4, the petals 150 may extend out such that a through-hole is formed in the middle of the applique removal element formed by the petals 150. The through-hole may be sized such that an applicator wand or a portion of an applicator will pass through the removal element without engaging the petals.

In addition, as shown in FIG. 2, the through-hole at the center of petals 150 may include a vertical edge along line 160 that is formed by the end of each petal 150 and defined by the thickness of the petals at the end. In some embodiments, the petal thickness may vary over the length of the petal such that the end of each petal is essentially a point where the minimum thickness at the end of the petal may be defined by a minimum rigidity necessary to remove the associated applique.

In this example, there are six petals. Such an arrangement has been found to optimize applique removal. However, different embodiments may include different numbers of petals, different arrangements of petals (e.g., petals of differing sizes), etc. Each petal may be able to move independently of the other petals. The petals may be of appropriate thickness (and the gaps between petals may be sized) such that the petals are at least somewhat flexible, while maintaining the rigidity necessary to remove excess applique.

The removal feature 100 may be made from various appropriate materials (e.g., plastic, rubber, silicon, etc.). The feature may have appropriate thickness and/or rigidity such that the feature is able to be inserted and retained in an applique vessel. In addition, some embodiments may be able to be removed from the vessel.

Although the feature 100 is shown as being cylindrical, different embodiments may have differently shaped elements (e.g., rectangular, oval, etc.), as appropriate to fit a particular vessel shape.

Figure 6:
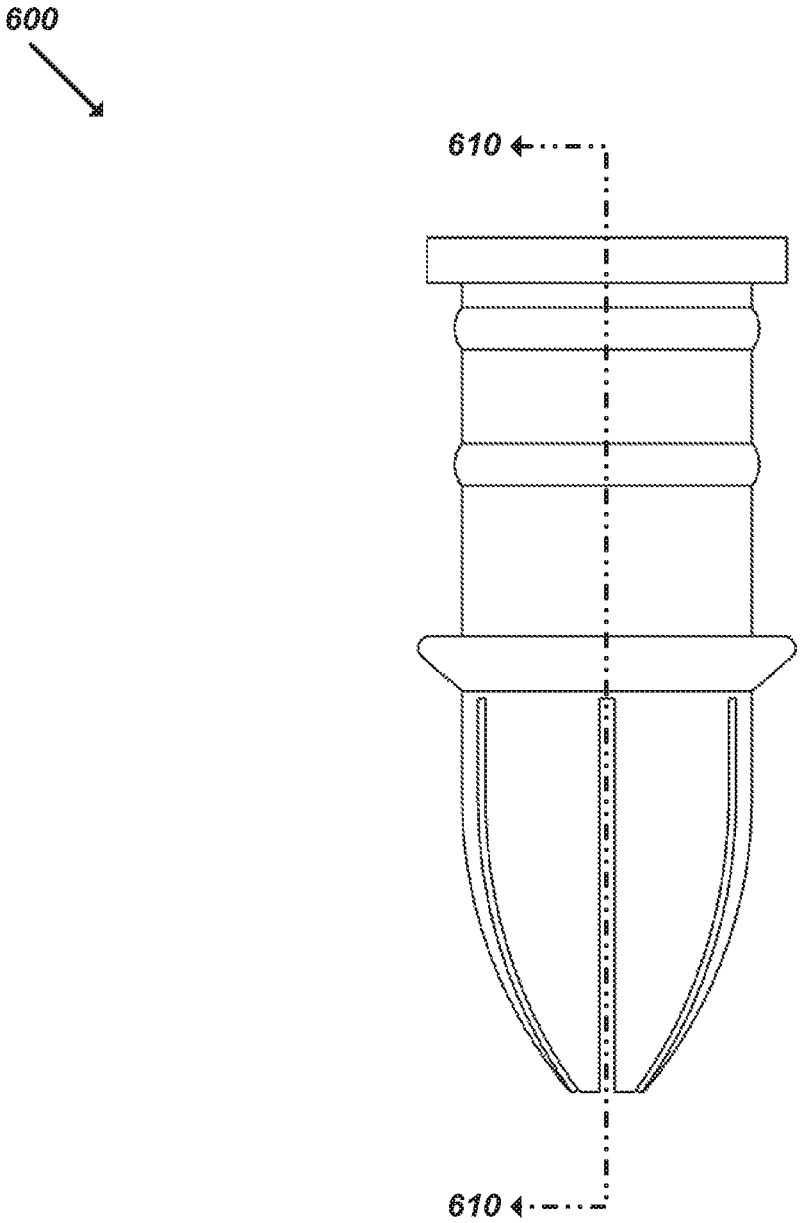
FIG. 6 illustrates a front elevation view of an alternative applique removal feature according to an exemplary embodiment.
Figure 7:
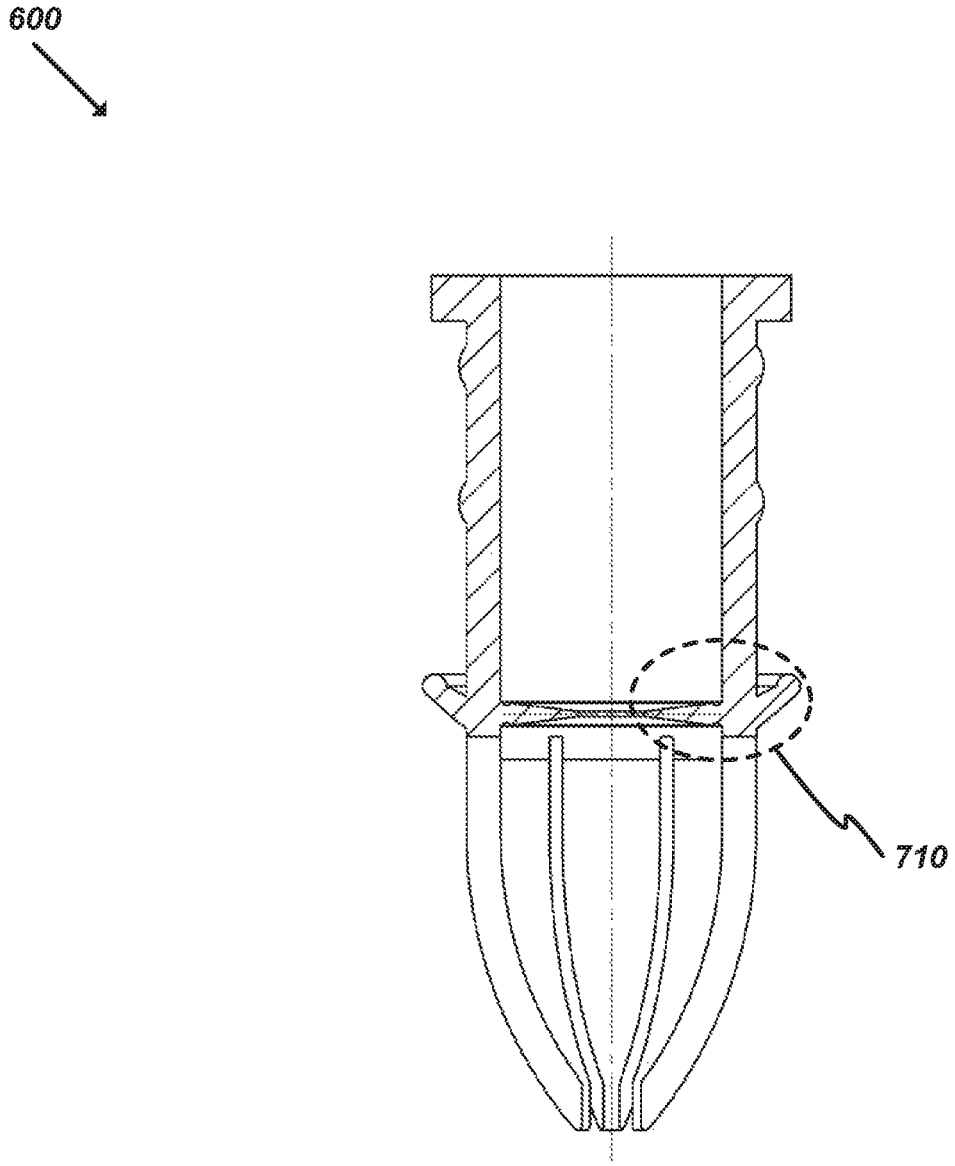
FIG. 7 illustrates a front section view of the applique removal feature of FIG. 6.
Figure 8:
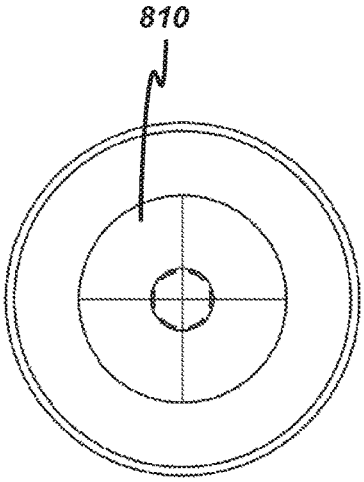
FIG. 8 illustrates a top plan view of the applique removal feature of FIG. 6.
Figure 9:
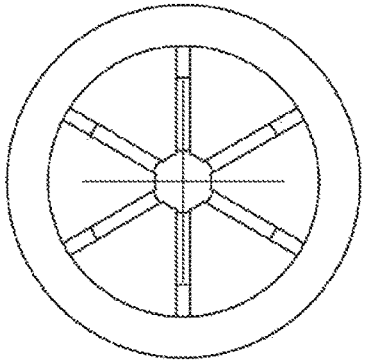
FIG. 9 illustrates a bottom plan view of the applique removal feature of FIG. 6.
Figure 10:
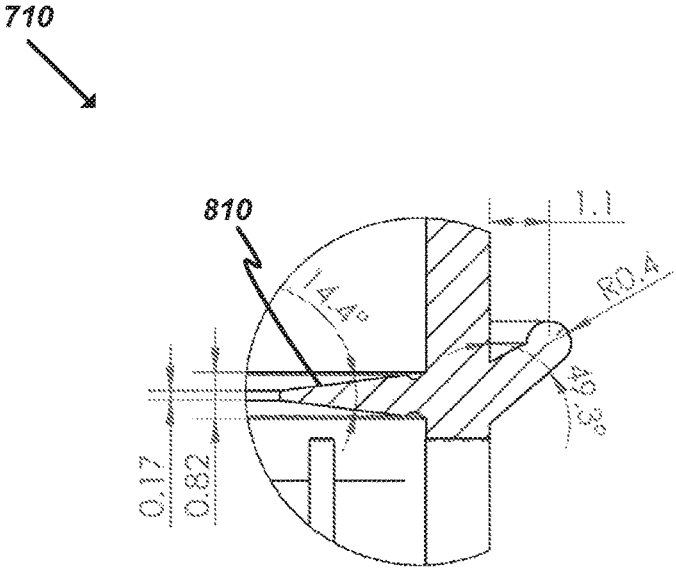
FIG. 10 illustrates a detailed front elevation view of a portion of the applique removal feature of FIG. 6.

FIG. 6 illustrates a front elevation view of an alternative applique removal feature 600 according to an exemplary embodiment. FIG. 7 illustrates a front section view of the applique removal feature 600 along line 610. FIG. 8 illustrates a top plan view of the applique removal feature 600. FIG. 9 illustrates a bottom plan view of the applique removal feature 600. FIG. 10 illustrates a detailed front elevation view of a portion 710 of the applique removal feature 600.

As shown, in addition to the applique removal element formed by petals 150, there is a second applique removal element 810 located above the petals 150 in the upright orientation as shown. As such, the second removal element 810 may engage the applicator after the petals 150 as the applicator is removed from the vessel.

The second applique removal element 810 may be a solid membrane (the crosshairs are shown for reference only) with a through-hole in the center. The removal element 810 may be made of materials having appropriate thickness and/or flexibility (e.g., plastic, rubber, silicon, etc.) such that an applicator may be drawn through the removal element 810 after passing through the petals 150. The second applique removal element 810 may be coupled to an inside surface or wall of the cylindrical body 130.

The through-hole may be sized such that an applicator wand may be able to pass through without contacting the element 810 while an application element (e.g., a mascara brush) may at least partially contact the element. The size of the hole and flexibility of the material may be varied in order to achieve different levels of applique removal. In addition, although the hole is shown as round, the hole may be differently shaped depending on the attributes of the applicator (e.g., wand type, brush type and/or shape, etc.).

Figure 11:
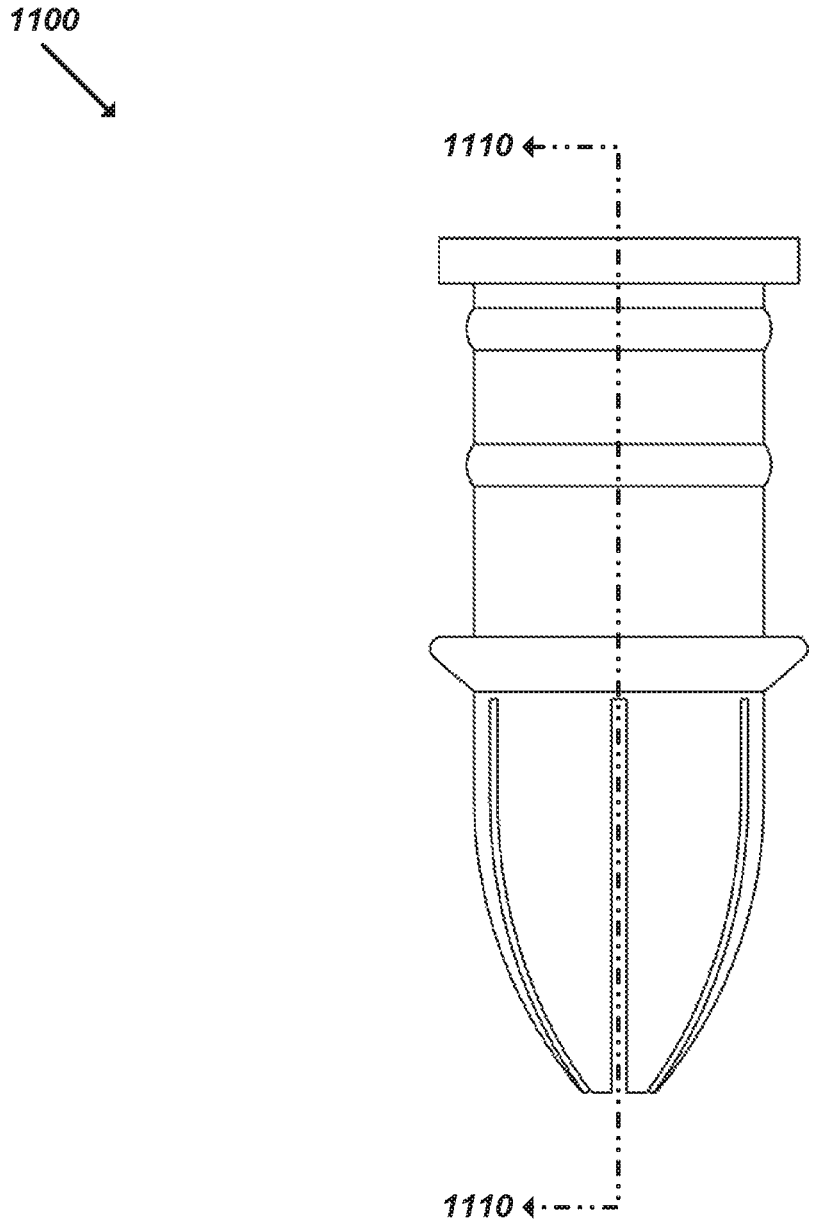
FIG. 11 illustrates a front elevation view of a second alternative applique removal feature according to an exemplary embodiment.
Figure 12:
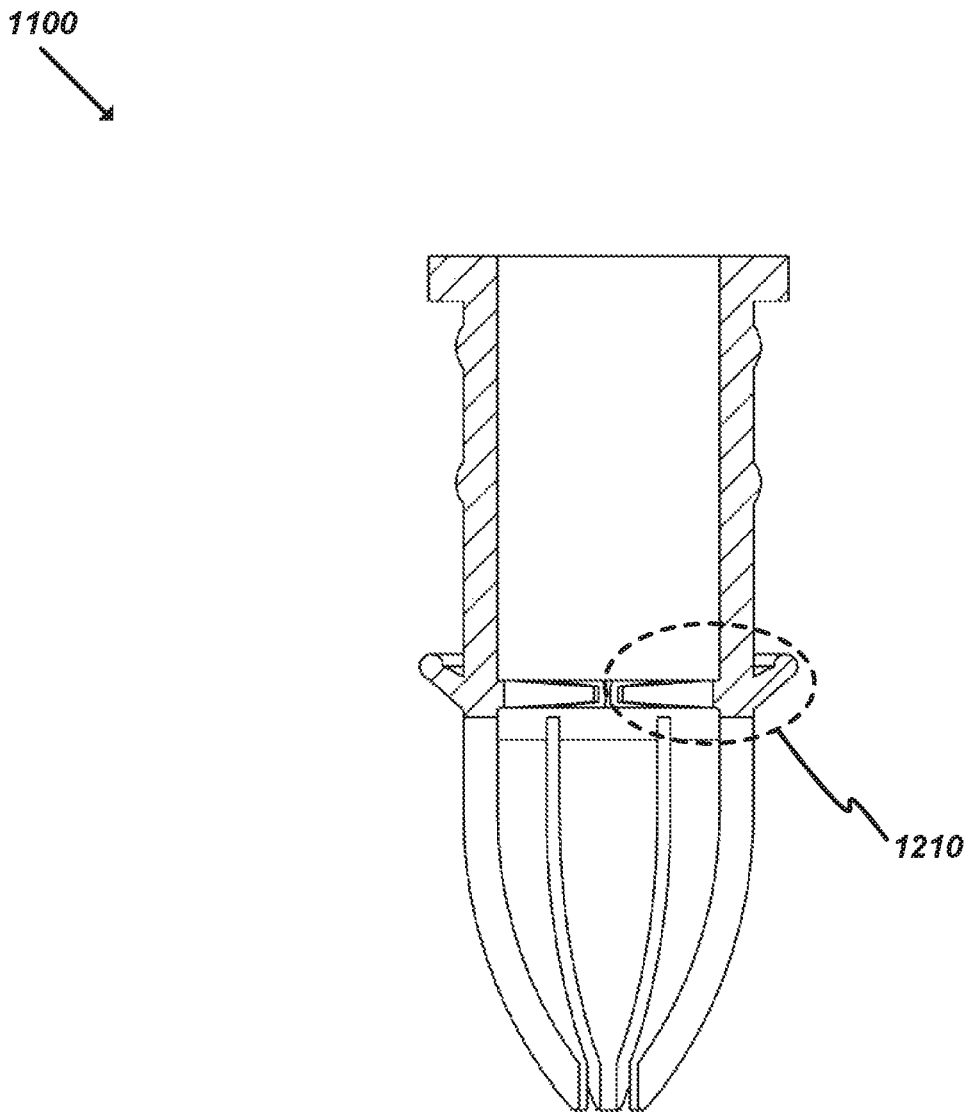
FIG. 12 illustrates a front section view of the applique removal feature of FIG. 11.
Figure 13:
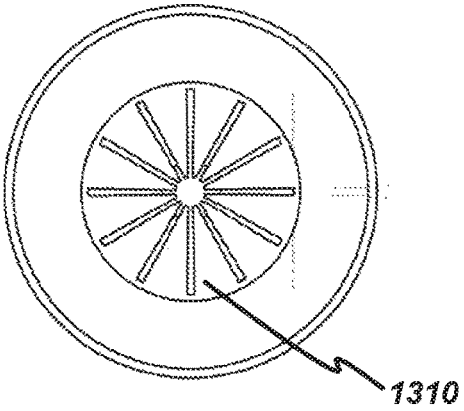
FIG. 13 illustrates a top plan view of the applique removal feature of FIG. 11.
Figure 14:
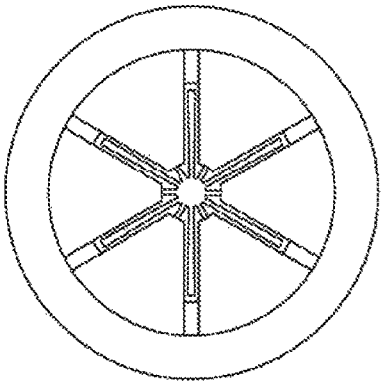
FIG. 14 illustrates a bottom plan view of the applique removal feature of FIG. 11.
Figure 15:
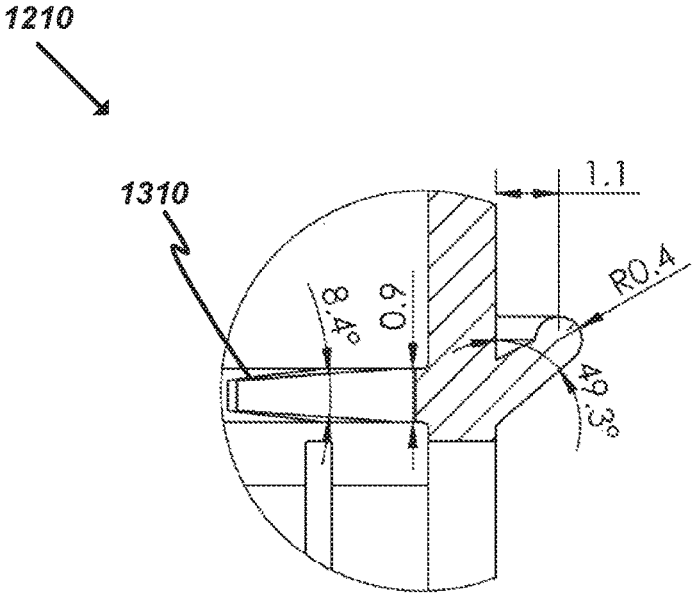
FIG. 15 illustrates a detailed front elevation view of a portion of the applique removal feature of FIG. 11.

FIG. 11 illustrates a front elevation view of a second alternative applique removal feature 1100 according to an exemplary embodiment. FIG. 12 illustrates a front section view of the applique removal feature 1100 along line 1110. FIG. 13 illustrates a top plan view of the applique removal feature 1100. FIG. 14 illustrates a bottom plan view of the applique removal feature 1100. FIG. 15 illustrates a detailed front elevation view of a portion 1210 of the applique removal feature 1100.

As shown, in addition to the applique removal element formed by petals 150, there is a second applique removal element 1210 located above the petals 150 in the upright orientation as shown. The second applique removal element 1210 may include multiple "fingers" or petals 1310 (in this example there are twelve fingers) distributed radially about a center axis of the body 130. The removal element 1210 may be made of materials having appropriate thickness and/or flexibility such that an applicator may be drawn through the removal element 1210 after passing through the petals 150.

The fingers 1310 may be of appropriate thickness (and the gaps between fingers may be sized) such that the fingers are at least somewhat flexible, while maintaining the rigidity necessary to remove excess applique. In this example, the fingers are triangular, but different embodiments may include differently shaped fingers (e.g., fingers with rounded ends). As above, the removal feature 1210 formed by the fingers 1310 may have a through-hole at the center that may allow an applicator wand or a portion of the applicator to pass through the removal feature 1210.

Figure 16:
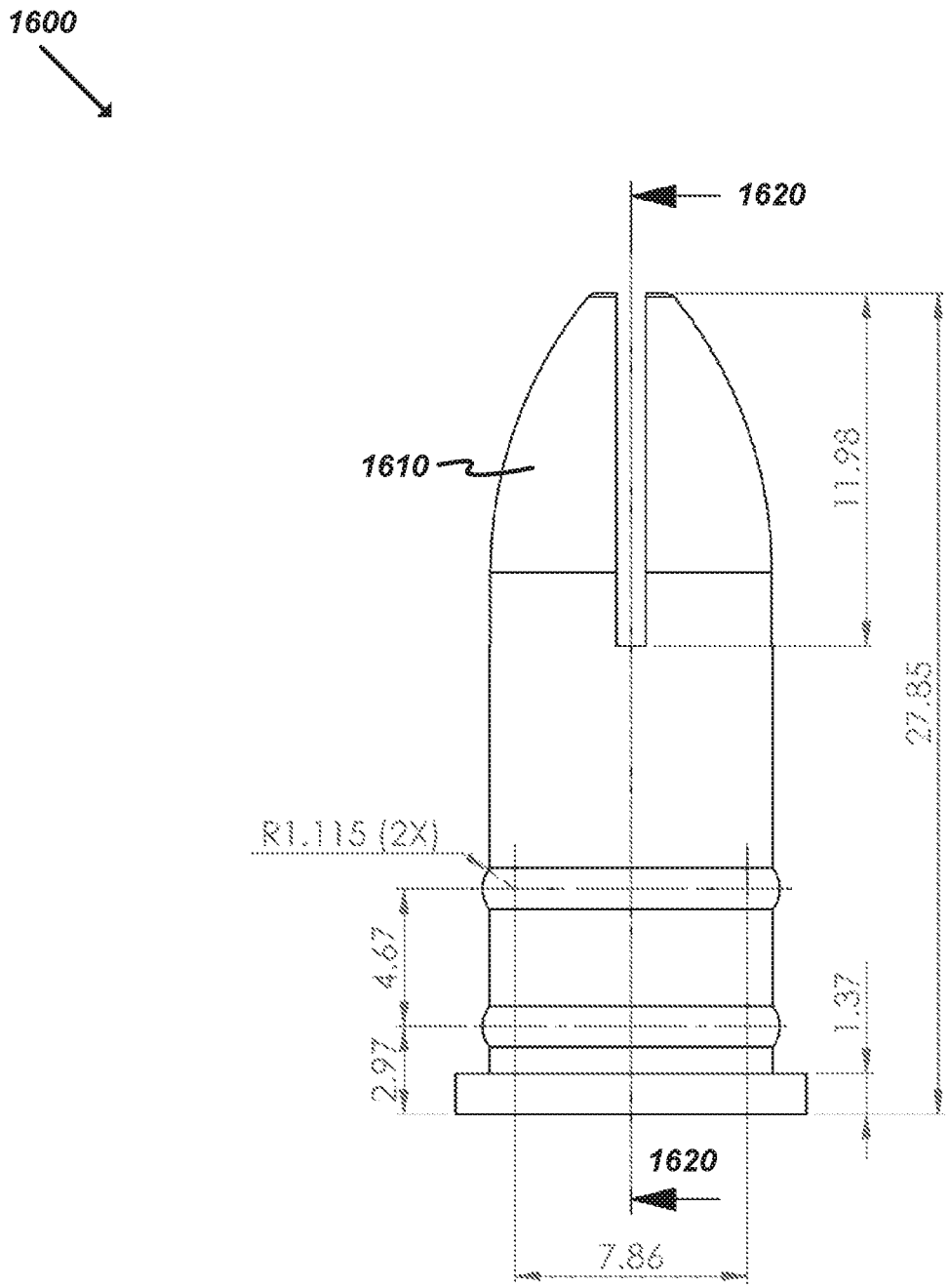
FIG. 16 illustrates a front elevation view of a third alternative applique removal feature according to an exemplary embodiment.
Figure 17:
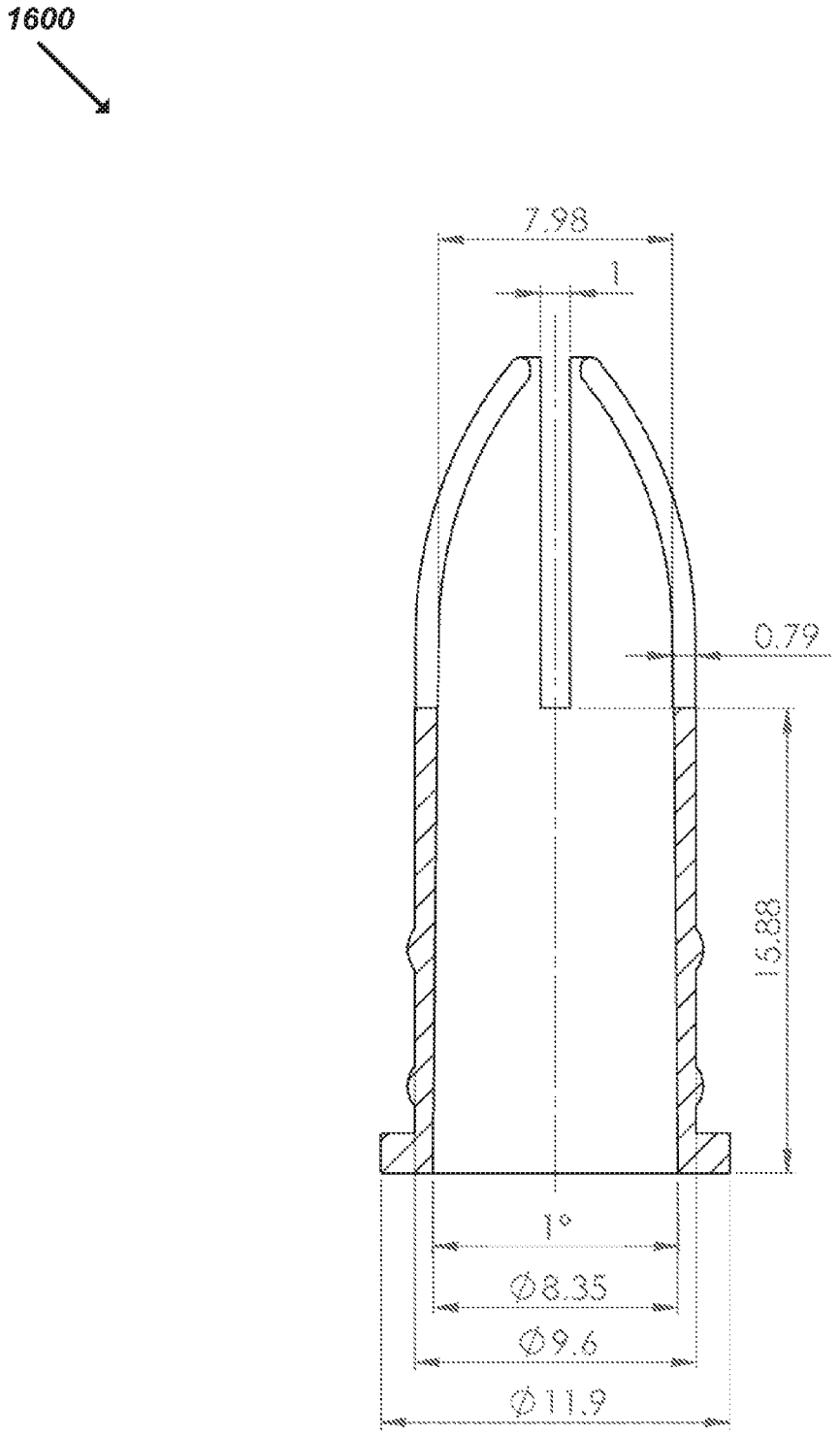
FIG. 17 illustrates a front section view of the applique removal feature of FIG. 16.
Figure 18:
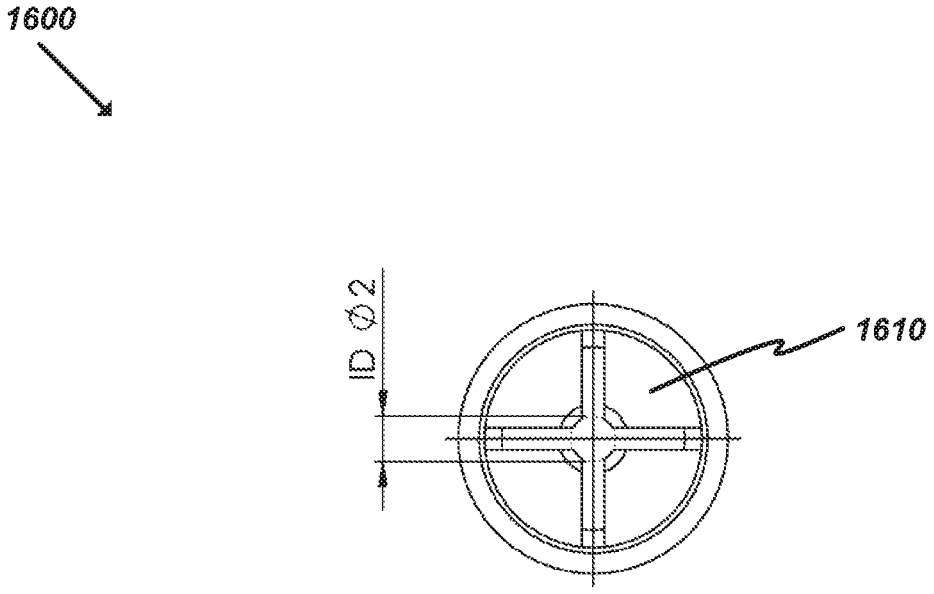
FIG. 18 illustrates a top plan view of the applique removal feature of FIG. 16.

FIG. 16 illustrates a front elevation view of a third alternative applique removal feature 1600 according to an exemplary embodiment. FIG. 17 illustrates a front section view of the applique removal feature 1600. FIG. 18 illustrates a top plan view of the applique removal feature 1600.

As shown, in this example, there are four petals 1610 included in the applique removal feature 1600. In addition, there is no retention element in this example.

Figure 19:
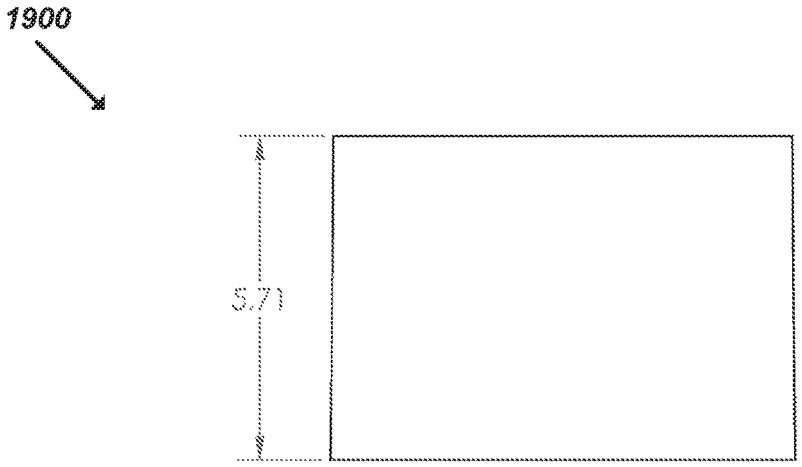
FIG. 19 illustrates a front elevation view of a secondary applique removal feature according to an exemplary embodiment.
Figure 20:
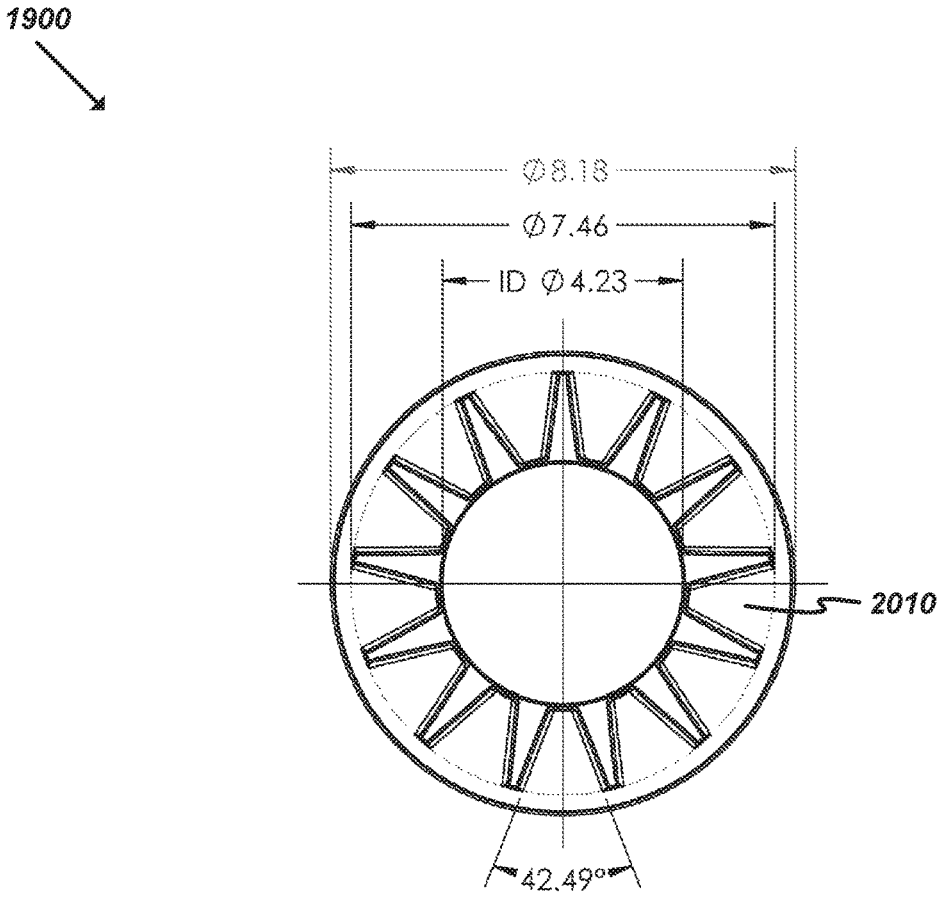
FIG. 20 illustrates a top plan view of the applique removal feature of FIG. 19.
Figure 21:
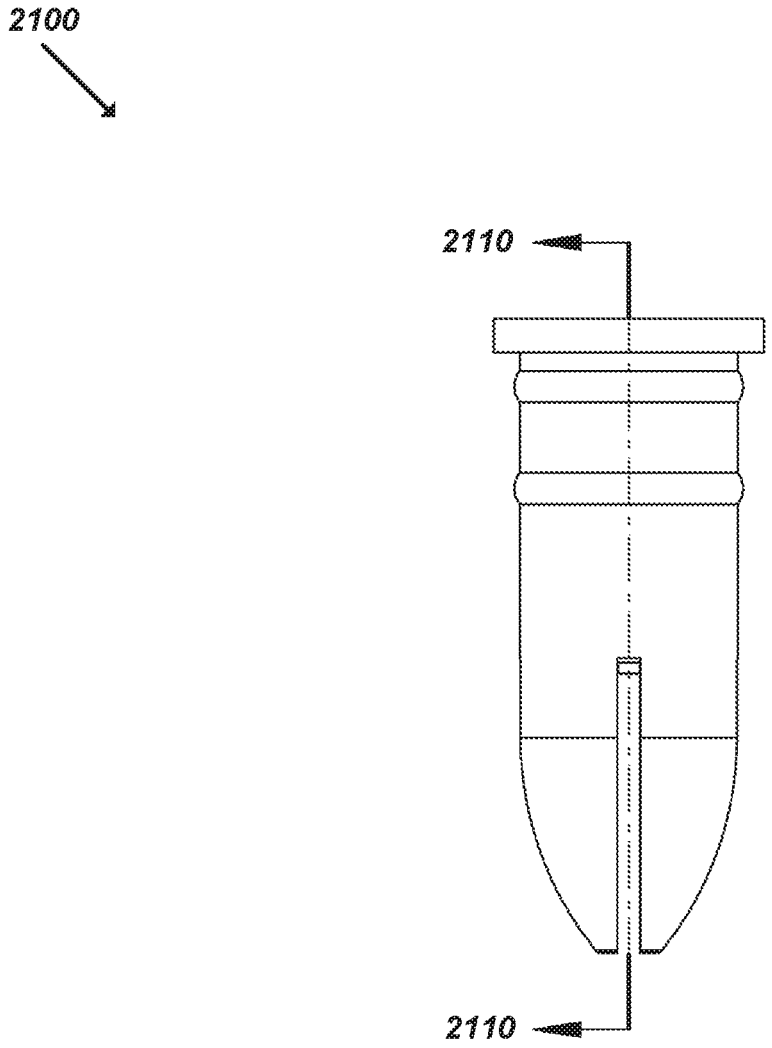
FIG. 21 illustrates a front elevation view of a fourth alternative applique removal feature according to an exemplary embodiment.
Figure 22:
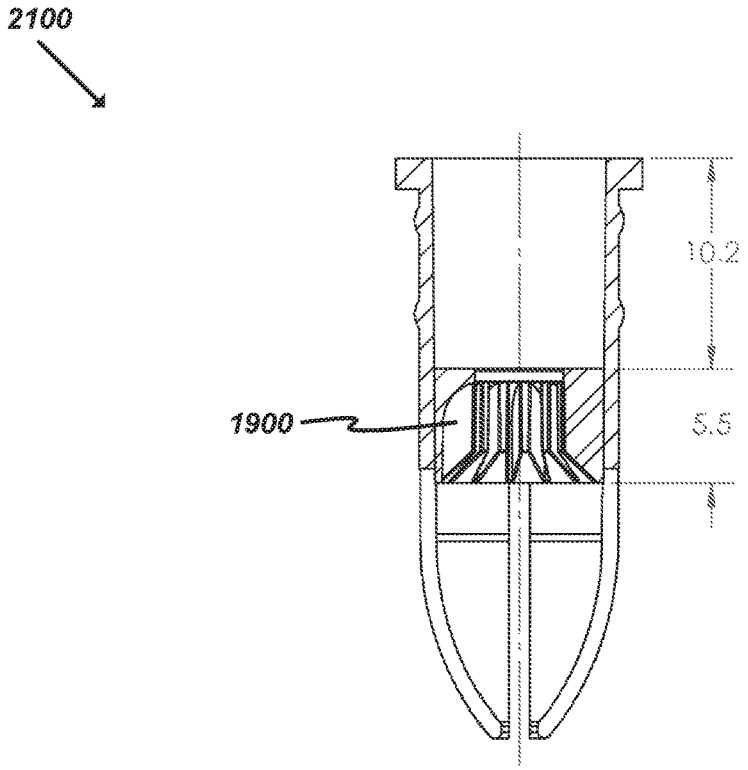
FIG. 22 illustrates a front section view of the applique removal feature of FIG. 21.
Figure 23:
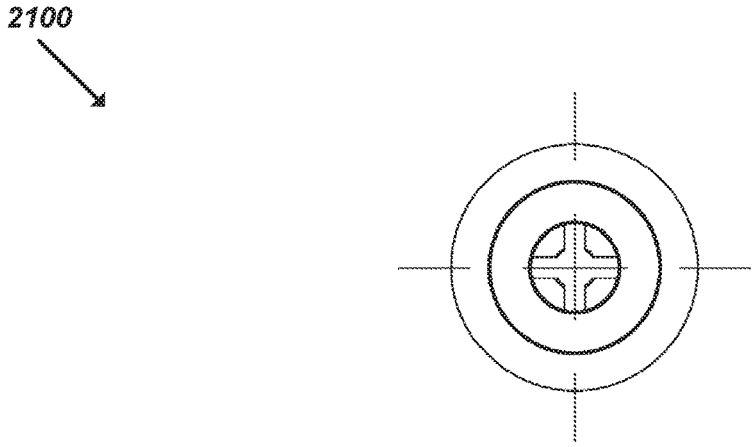
FIG. 23 illustrates a top plan view of the applique removal feature of FIG. 21.

FIG. 19 illustrates a front elevation view of a secondary applique removal feature 1900 according to an exemplary embodiment. FIG. 20 illustrates a top plan view of the applique removal feature 1900. FIG. 21 illustrates a front elevation view of a fourth alternative applique removal feature 2100 according to an exemplary embodiment. FIG. 22 illustrates a front section view of the applique removal feature 2100 along line 2110. FIG. 23 illustrates a top plan view of the applique removal feature 2100.

As shown, in addition to the applique removal element formed by petals 150, there is a second applique removal element 1900 located above the petals 1610 in the upright orientation as shown. The second applique removal element 1900 may include a number of ridges 2010 that extend from an outer diameter to an inner diameter along a vertical axis that runs along line 2110. The removal element 1900 may utilize appropriate materials and be of appropriate thickness such that the removal element is rigid in comparison to an application element such as a brush.

Figure 24:
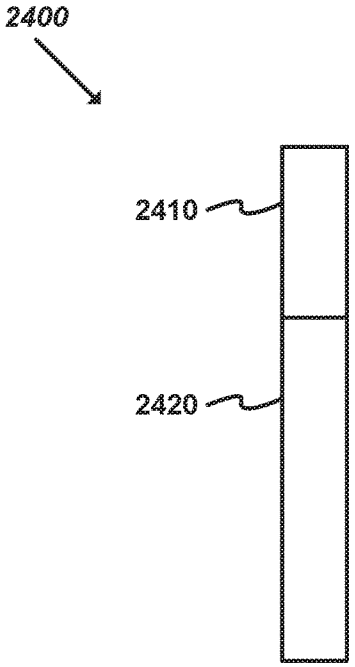
FIG. 24 illustrates a front elevation view of an applique vessel that may be utilized with some embodiments.

FIG. 24 illustrates a front elevation view of an applique vessel 2400 that may be utilized with some embodiments. As shown, the vessel may include an applicator 2410 and a reservoir 2420. The reservoir may store an amount of applique (e.g., mascara).

Figure 25:
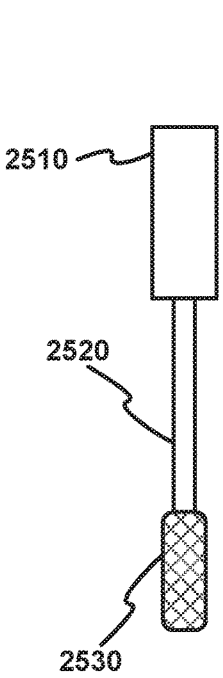
FIG. 25 illustrates a front elevation view of an applicator included in the vessel of FIG. 24.

FIG. 25 illustrates a front elevation view of the applicator 2410 included in the vessel 2400. As shown, the applicator 2410 may include a handle 2510, a wand 2520, and an application element 2530.

Figure 26:
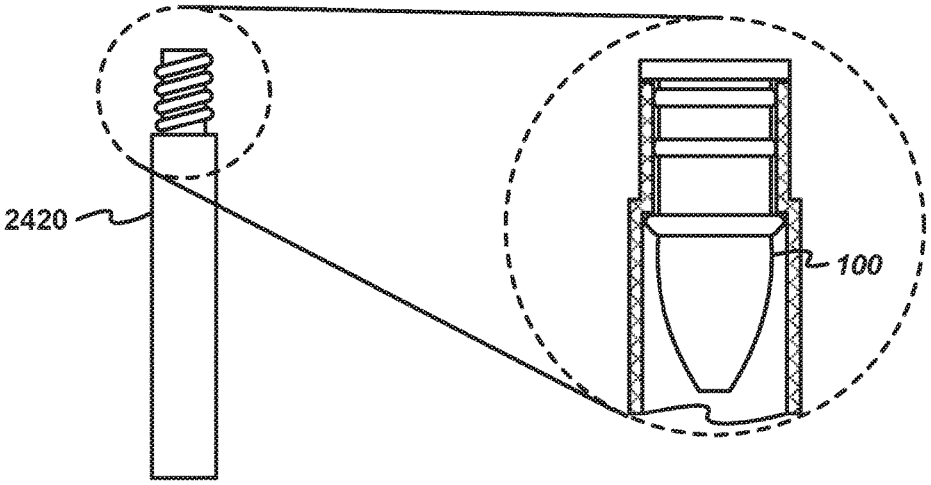
FIG. 26 illustrates an exploded front elevation view of the vessel of FIG. 24 including the applique removal feature of FIG. 1.

FIG. 26 illustrates an exploded front elevation view of the vessel 2400 including the applique removal feature 100.

As shown, the feature 100 may be inserted into the neck of vessel 2420 such that the lip 110 rests on the rim of the neck. In addition, the ridges 120 may engage the sides of the neck such that the insert 100 is held in place and the body 130 is able to maintain rigidity. The retention feature 140 may engage the ridge formed at the joint of the neck and the reservoir such that the insert 100 does not slide in or out during use.

As shown in detailed sections 210, 710, or 1210 above, the retention feature 140 may be able to be compressed toward the body 130 during insertion and then may expand out after passing the base of the neck to engage the ridge at the base, thus securing the insert 100 in place. In addition, the feature 140 may be flexible enough that the insert 100 is able to be removed from the vessel and re-used with a different vessel.

The foregoing relates to illustrative details of exemplary embodiments and modifications may be made without departing from the scope of the disclosure as defined by the following claims.

I claim:

1. An insertable applique removal feature comprising:

a protruding lip;

a cylindrical body coupled to the protruding lip; and an applique removal element comprising a plurality of inwardly curving petals, wherein each inwardly curving petal from the plurality of inwardly curving petals is coupled to the cylindrical body and is separated from each adjacent petal by a gap when said petals are in a relaxed state, wherein each inwardly curving petal from the plurality of inwardly curving petals has a substantially constant thickness along a longitudinal cross section thereof throughout a length thereof.

2. The insertable applique removal feature of claim 1 further comprising a retention feature coupled to the cylindrical body.

3. The insertable applique removal feature of claim 1, wherein the plurality of petals form a convex shape that protrudes from one end of the cylindrical body.

4. The insertable applique removal feature of claim 3, wherein the plurality of petals comprises six petals.

5. The insertable applique removal feature of claim 1, wherein the insertable applique removal feature is able to be at least partially inserted into a mascara tube.

6. The insertable applique removal feature of claim 1 further comprising a secondary applique removal element located along an interior wall of the cylindrical body.

7. The insertable applique removal feature of claim 6, wherein the secondary applique removal element comprises a flexible membrane having a through-hole.

8. A mascara tube comprising:

a cylindrical neck having a first radius;

a cylindrical reservoir coupled the cylindrical neck, the cylindrical reservoir having a second radius, wherein the second radius is greater than the first radius;

a first mascara removal feature comprising:

a cylindrical body located along an interior surface of the cylindrical neck; and a set of petals protruding from one end of the cylindrical body and forming a convex shape that extends into a portion of the cylindrical reservoir, wherein each petal from the set of petals is separated from each adjacent petal by a gap when the petals are in a relaxed state and comprises a concave inner surface, and wherein each petal from the set of petals has a substantially constant thickness along a longitudinal cross section thereof throughout a length thereof.

9. The mascara tube of claim 8, wherein the set of petals extend out such that an opening is formed at one end of the convex shape.

10. The mascara tube of claim 9, wherein the opening is sized such that an applicator wand is able to pass through the opening without engaging any petal in the set of petals.

11. The mascara tube of claim 8, wherein the set of petals and the gaps between the set of petals are arranged symmetrically about an axis of the cylindrical body.

12. The mascara tube of claim 8 further comprising a second mascara removal feature located along an inner surface of the cylindrical body.

13. The mascara tube of claim 12, wherein the second mascara removal feature comprises a flexible membrane with a through-hole.

14. The mascara tube of claim 12, wherein the second mascara removal feature comprises a set of fingers protruding from an inner wall of the cylindrical body.

15. A mascara tube insert comprising:

a lip able to engage an outer edge along a mouth of a mascara tube;

a retention element able to engage an edge at a joint of a neck of the mascara tube and a reservoir of the mascara tube; and a first mascara removal feature comprising:

a set of petals that extend out from one end of the cylindrical body to form a concave inner and a convex outer shape, wherein each petal in the set of petals is separated from each adjacent petal by a gap when the petals are in a relaxed state and has a substantially constant thickness along a longitudinal cross section thereof throughout a length thereof.

16. The mascara tube insert of claim 15 further comprising a cylindrical body, wherein the set of petals extends out from one end of the cylindrical body.

17. The mascara tube insert of claim 16, wherein the set of petals is arranged symmetrically about a center axis of the cylindrical body.

18. The mascara tube insert of claim 16 further comprising a second mascara removal feature.

19. The mascara tube insert of claim 18, wherein the second mascara removal feature comprises a flexible membrane with a through-hole, the flexible membrane coupled to an inner surface of the cylindrical body.

20. The mascara tube insert of claim 18, wherein the second mascara removal feature comprises a set of fingers distributed radially about the cylindrical body.

* * * * *